US011169480B2

(12) United States Patent
Yuasa et al.

(10) Patent No.: US 11,169,480 B2
(45) Date of Patent: Nov. 9, 2021

(54) HOLDER

(71) Applicant: Konica Minolta, Inc., Tokyo (JP)

(72) Inventors: Takafumi Yuasa, Toyokawa (JP); Masahiko Takahashi, Hino (JP); Daisuke Kobayashi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/004,535

(22) Filed: Aug. 27, 2020

(65) Prior Publication Data

US 2021/0063938 A1 Mar. 4, 2021

(30) Foreign Application Priority Data

Aug. 30, 2019 (JP) ..... JP2019-158958

(51) Int. Cl.
*G03G 15/00* (2006.01)

(52) U.S. Cl.
CPC . *G03G 15/605* (2013.01); *G03G 2215/00185* (2013.01)

(58) Field of Classification Search
CPC ..... G03G 15/605; G03G 2215/00185; G03G 15/70
See application file for complete search history.

(56) References Cited

U.S. PATENT DOCUMENTS

| | | | | |
|---|---|---|---|---|
| 10,901,356 | B2 * | 1/2021 | Mitsui | B65H 5/36 |
| 10,948,862 | B2 * | 3/2021 | Ohzawa | G03G 15/5029 |
| 2018/0118488 | A1 * | 5/2018 | Suzuki | G03G 15/2017 |

FOREIGN PATENT DOCUMENTS

| | | | |
|---|---|---|---|
| JP | 2004198460 | A | 7/2004 |
| JP | 2019055856 | A | 4/2019 |

* cited by examiner

*Primary Examiner* — Susan S Lee
(74) *Attorney, Agent, or Firm* — Lucas & Mercanti, LLP

(57) ABSTRACT

A holder includes first and second attachments to be attached to an attachment target part of an image formation apparatus. The first attachment is located on a reflection light source side relative to a sensor in a direction of a line connecting the sensor and a reflection light source of the image formation apparatus The second attachment is located on an opposite side to the reflection light source relative to the sensor in the line direction. A holder includes first, second, and third attachments to be attached to an attachment target part of an image formation apparatus. The three attachments are elastically deformable portions. The first and second attachments are provided on one end side of the holder. The third attachment is provided on other end side of the holder. The three attachments are provided as to clamp the attachment target part by using resilience associated with elastic deformation.

11 Claims, 9 Drawing Sheets

HOLDER

CROSS REFERENCE TO RELATED APPLICATIONS

The present application claims priority from Japanese Patent Application No. 2019-158958 filed on Aug. 30, 2019, the contents of which are hereby incorporated by reference in this application.

BACKGROUND

Technological Field

The present invention relates to a technique for detecting calibration data in an image formation apparatus.

Description of the Related Art

An image formation apparatus such as an MFP or a PP involves different fixing conditions and the like depending on recording media (such as paper types) and therefore requires a setting corresponding to each paper type. While a user would change paper type settings through a panel or the like in past days, apparatuses designed to change settings by automatically identifying paper types while using a sensor have been developed in recent years. As the sensor for automatically setting the paper type, there is one configured to irradiate paper with light and to identify the paper type and its basis weight by using an amount of reflected light and an amount of transmitted light. Differences of light amount values from corresponding reference values are used for identification of the paper type and calculation of the basis weight, and values measured by using reference paper (a sheet) at the time of initial adjustment are used as the reference values. In this method, fluctuations of the reference values adversely affect identification of the paper type and calculation of the basis weight. In particular, the amount of reflect light varies with a change in distance between the reference paper and the sensor (a light source) due to rotation of the reference paper around an axis in a width direction thereof, thus deteriorating accuracy of identification of the paper type and calculation of the basis weight. Patent Literatures 1 and 2 disclose method of obtaining calibration data (the reference values) in such an image formation apparatus.

Patent Literature 1: Japanese Patent Application Publications No. 2004-198460

Patent Literature 2: Japanese Patent Application Publications No. 2019-055856

SUMMARY

While the apparatus disclosed in Patent Literature 1 includes a reflector for calibration which is fitted to a film conveyance line, a specific fitting method thereof is obscure and it is unclear whether or not the reflector can maintain a constant distance from a sensor. On the other hand, in the apparatus disclosed in Patent Literature 2, a calibration member is held by a holding plate. However, it is obscure whether or not this member can maintain a constant distance from a sensor.

The present invention has been made in view of the aforementioned circumstances.

To achieve at least one of the abovementioned objects, according to an aspect of the present invention, 1. A holder configured to hold a reference sheet in order to calibrate a sensor configured to optically measure a characteristic of a sheet on a sheet conveyance path in an image formation apparatus comprises first and second attachments to be attached to an attachment target part of the image formation apparatus, in which the first attachment is located on a reflection light source side relative to the sensor in a direction of a line connecting the sensor and a reflection light source of the image formation apparatus, and the second attachment is located on an opposite side to the reflection light source relative to the sensor in the direction of the line;

2. A holder configured to hold a reference sheet in order to calibrate a sensor configured to optically measure a characteristic of a sheet on a sheet conveyance path in an image formation apparatus comprises first, second, and third attachments to be attached to an attachment target part of the image formation apparatus, in which the first, second, and third attachments are elastically deformable portions, the first and second attachments are provided on one end side of the holder and the third attachment is provided on other end side of the holder, and the first, second, and third attachments are provided in such a way as to clamp the attachment target part by using resilience associated with elastic deformation.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 6A and 6B are cross-sectional views taken along the VI-VI line in FIG. 5, in which FIG. 6A is a view showing a state where the holder is attached to a conveyance guide and FIG. 6B is a view showing a state where the holder is rotated relative to the conveyance guide;

FIGS. 7A and 7B are cross-sectional views taken along the VII-VII line in FIG. 5, in which FIG. 7A is a view showing a state where the holder is attached to the conveyance guide and FIG. 7B is a view showing a state where the holder is rotated relative to the conveyance guide;

DETAILED DESCRIPTION OF EMBODIMENTS

Hereinafter, one or more embodiments of the present invention will be described with reference to the drawings. However, the scope of the invention is not limited to the disclosed embodiments.

An embodiment of the present invention will be described below in detail with reference to the accompanying drawings as appropriate. Note that the same constituents are denoted by the same reference signs and overlapping explanations thereof will be omitted.

<Image Formation Apparatus>

Figure 1:
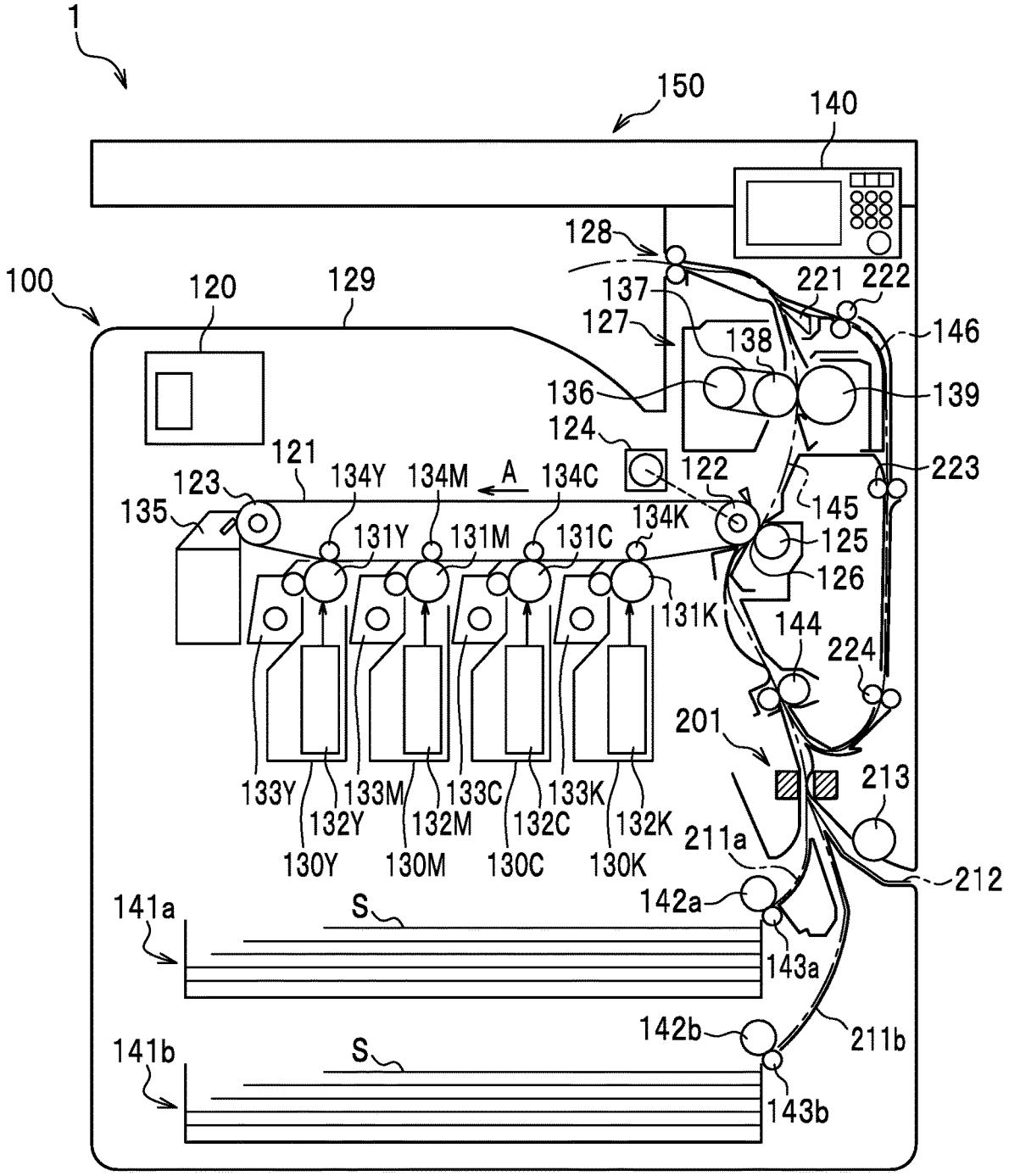
FIG. 1 is a diagram schematically showing an image formation apparatus according to an embodiment of the present invention.

As shown in FIG. 1, an image formation apparatus 1 according to an embodiment of the present invention is a so-called tandem-type copier configured to form color images, which is formed from an image forming unit 100 and an image reading unit 150. The image reading unit 150 optically reads an image on an original placed on a not-illustrated glass platen or on an original conveyed by a not-illustrated automatic document feeder (ADF), and generates color image data by separating the read image into three primary colors of red, green, and blue (RGB).

The image forming unit 100 includes a control unit 120. The control unit 120 subjects the color image data generated by the image reading unit 150 to image processing, and causes the image forming unit 100 to execute color image formation processing by using the color image data. The control unit 120 may execute the image formation processing by accepting a printing job from an external device such as a personal computer (PC).

The image formation processing is executed by causing four imaging units 130Y, 130M, 130C, and 130K to form toner images of respective colors of yellow (Y), magenta (M), cyan (C), and black (K). The imaging units 130Y, 130M, 130C, and 130K include photoconductor drums 131Y, 131M, 131C, and 131K, laser scanning optical units 132Y, 132M, 132C, and 132K, development units 133Y, 133M, 133C, and 133K, and not-illustrated charging units as well as cleaning units, respectively.

The charging units uniformly charge outer peripheral surfaces of the photoconductor drums 131Y, 131M, 131C, and 131K. The laser scanning optical units 132Y, 132M, 132C, and 132K irradiate the outer peripheral surfaces of the photoconductor drums 131Y, 131M, 131C, and 131K with laser beams modulated in accordance with digital image data of respective color components, thereby forming electrostatic latent images thereon.

The development units 133Y, 133M, 133C, and 133K supply toners of Y, M, C, and K colors, respectively, thus visualizing the electrostatic latent images and forming respective toner images of the Y, M, C, and K colors. The imaging units 130Y, 130M, 130C, and 130K are disposed immediately below an intermediate transfer belt 121 and along the intermediate transfer belt 121.

Primary transfer rollers 134Y, 134M, 134C, and 134K are installed at positions opposed to the photoconductor drums 131Y, 131M, 131C, and 131K while interposing the intermediate transfer belt 121 in between. A primary transfer voltage is applied to the primary transfer rollers 134Y, 134M, 134C, and 134K, and the toner images carried by the photoconductor drums 131Y, 131M, 131C, and 131K are electrostatically transferred onto the intermediate transfer belt 121 in such a way as to overlap one another (primary transfer). Hence, a color toner image is formed.

The intermediate transfer belt 121 is an endless belt which runs through a driving roller 122, a driven roller 123, and the primary transfer rollers 134Y, 134M, 134C, and 134K. As a consequence of rotary drive of the driving roller 122 with a motor 124, the intermediate transfer belt 121 is rotated in a direction of an arrow A. A secondary transfer roller 125 is in pressure contact with the driving roller 122 while interposing the intermediate transfer belt 121 in between, thus forming a secondary transfer nip 126.

Paper feed cassettes 141*a* and 141*b* stacking and holding print sheets S are installed at a lower stage of the image forming unit 100. Paper feed rollers 142*a* and 142*b* send the print sheets S out of the paper feed cassettes 141*a* and 141*b*, respectively. Separation rollers 143*a* and 143*b* prevents overlap feeding of the print sheets S when the sheets are sent out.

The print sheets S sent out of the paper feed cassettes 141*a* and 141*b* are passed through sheet conveyance paths 211*a* and 211*b* and conveyed to a sheet conveyance path 145. Print sheets S that are supplied from a not-illustrated manual feed tray is conveyed by a manual feed roller 213 from a sheet conveyance path 212 to the sheet conveyance path 145. When each print sheet S reaches paired registration rollers 144 in this way, the print sheet S is subjected to skew correction by butting the paired registration rollers 144 at rest and forming a loop accordingly.

Then, the print sheet S is conveyed to the secondary transfer nip 126 as the paired registration rollers 144 start rotation in conformity to the timing of conveyance of the color toner image to the secondary transfer nip 126 by rotation of the intermediate transfer belt 121. A secondary transfer voltage is applied to the secondary transfer roller 125 and the color toner image is electrostatically transferred from the intermediate transfer belt 121 onto the print sheet S (secondary transfer).

After the secondary transfer, the toners left on the intermediate transfer belt 121 are scraped off by a cleaning device 135 and are disposed of. The print sheet S is conveyed to a fixation unit 127. The fixation unit 127 includes a heating roller 136, a fixing belt 137, a fixing roller 138, and a pressing roller 139. The heating roller 136 is heated by a not-illustrated heater so as to heat the fixing belt 137 up to a fixing temperature.

The fixing belt 137 is an endless belt which is driven and rotated by the fixing roller 138. The fixing roller 138 is driven by a not-illustrated motor. The pressing roller 139 comes into pressure contact with the fixing roller 138 while interposing the fixing belt 137 in between, thus forming a fixation nip. The color toner image is thermally fusion bonded to the print sheet S when the print sheet S is passed through the fixation nip.

After the fixation, a paper ejection roller 128 ejects the print sheet S onto a paper output tray 129 located at an upper part of the image forming unit 100. When duplex printing takes place, a sheet conveyance direction of the print sheet S is inverted by the paper ejection roller 128 and the print sheet S is conveyed to a sheet inversion path 146 by a claw 221. Then, the print sheet S is conveyed to the paired registration rollers 144 by paired conveyance rollers 223 and 224. Thereafter, another color image is secondarily transferred onto the back surface at the secondary transfer nip 126.

In addition, the image forming unit 100 includes an operating panel 140 which presents information to a user of the image formation apparatus 1 or accepts input of instructions.

Meanwhile, a photosensor 201 used by the control unit 120 for identifying a sheet type of the print sheet S is installed at a position where the three sheet conveyance paths 211*a*, 211*b*, and 212 join together into the single sheet conveyance path 145. In order that the print sheet S can form the loop for correcting the skew, the position to install the photosensor 201 is located upstream of the paired registration rollers 144 on the sheet conveyance path 145 and is located upstream of a position where the sheet inversion path 146 and the sheet conveyance path 145 join together.

<Calibration System>

Figure 2:
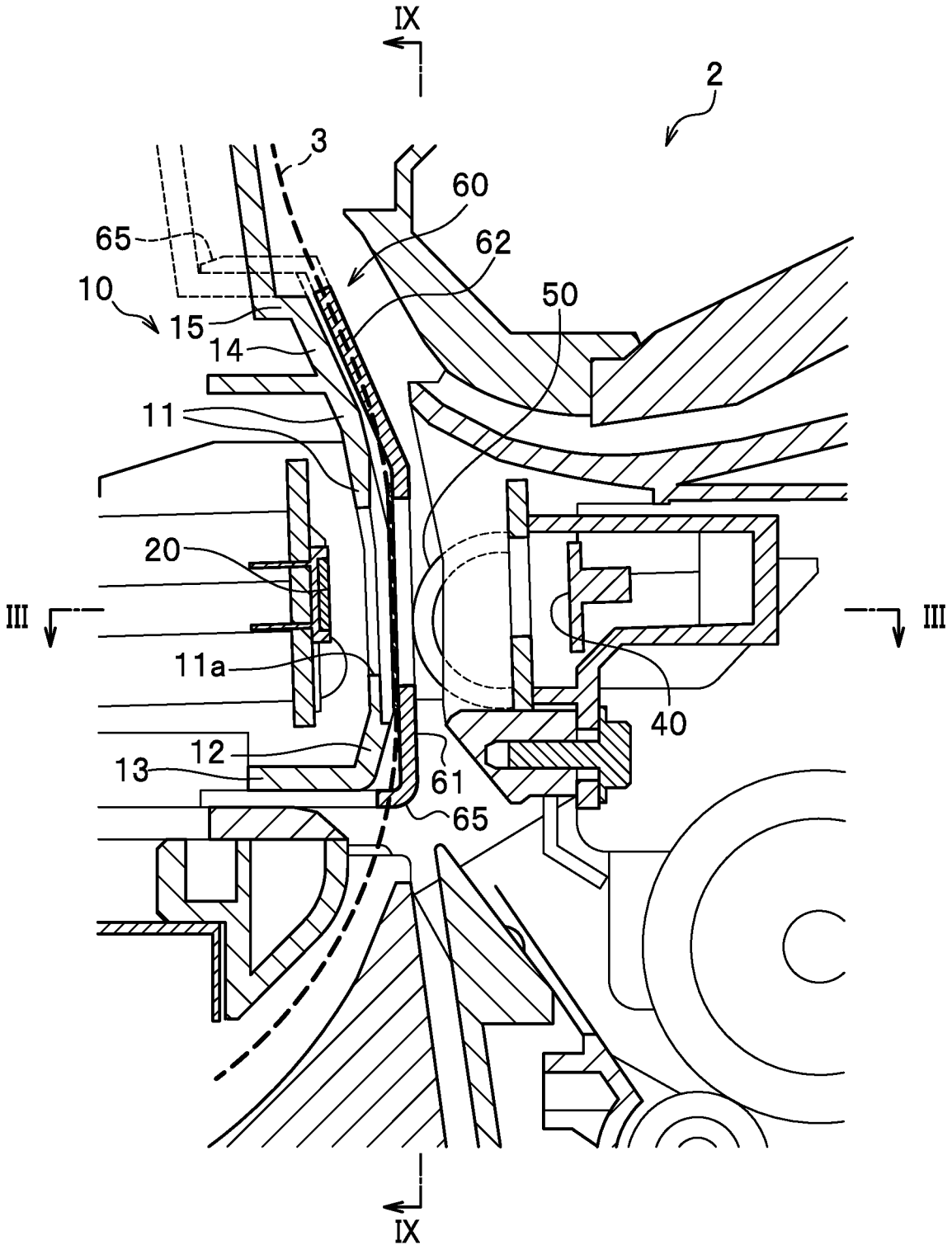
FIG. 2 is a diagram schematically showing a calibration system according to the embodiment of the present invention, which is a cross-sectional view of a sheet conveyance path viewed from a width direction.
Figure 3:
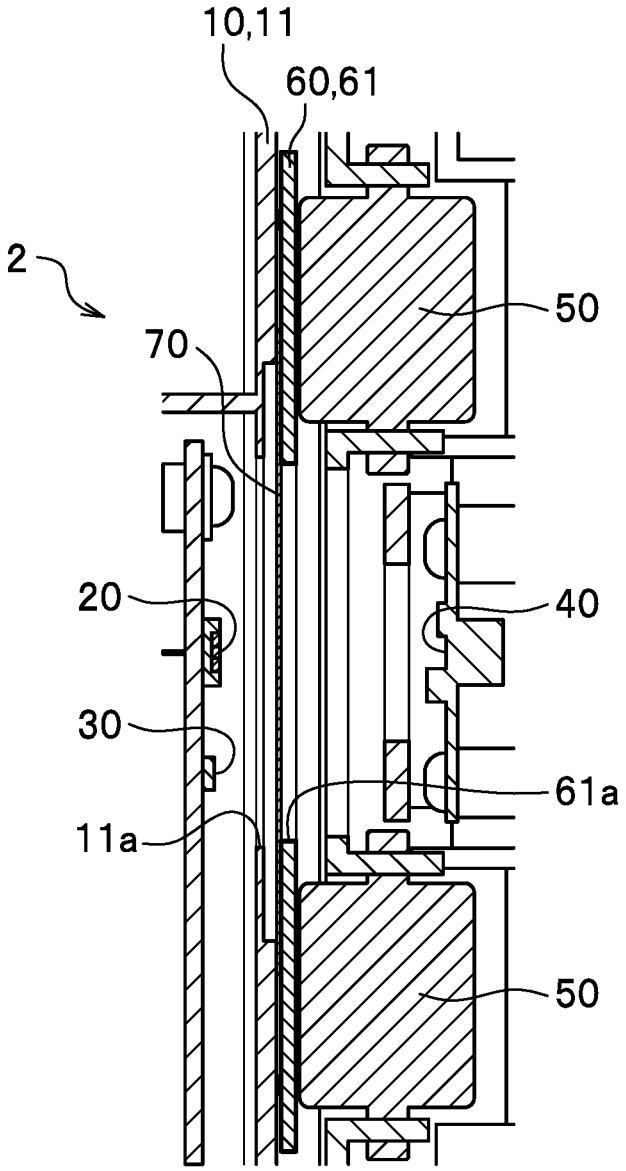
FIG. 3 is a diagram schematically showing the calibration system according to the embodiment of the present invention, which is a cross-sectional view taken along the line in FIG. 2.

As shown in FIGS. 2 and 3, a calibration system 2 according to the embodiment of the present invention is a system configured to detect data used for calibrating the amount of light reflected from the print sheet S and the amount of light transmitted through the print sheet S in the image formation apparatus 1. The calibration system 2 according to the embodiment of the present invention includes a conveyance guide 10, a sensor 20, a reflection light source 30, a transmission light source 40, and driven rollers 50, which serve as components of the image formation apparatus 1. The sensor 20, the reflection light source 30, and the transmission light source 40 collectively constitute the aforementioned photosensor 201. The conveyance guide 10 constitutes part of a housing that houses the sensor 20 and the reflection light source 30. The sensor 20 and the reflection light source 30 are fixed to this housing. The calibration system 2 also includes a holder 60 and a reference sheet 70 (see FIG. 4A). Here, the conveyance guide 10, the sensor 20, and the reflection light source 30 are components on the sensor 20 side relative to the holder 60, which collectively serve as an attachment target part to which the holder 60 is attached.

<Conveyance Guide>

The conveyance guide 10 is a member to define a sheet conveyance path 3 in the vicinity of the photosensor 201. The print sheet S is conveyed along the conveyance guide 10. The conveyance guide 10 includes a main wall portion 11, an inclined wall portion 12 as well as a side wall portion 13 located on an upstream side of the main wall portion 11, and an inclined wall portion 14 as well as a side wall portion 15 located on a downstream side of the main wall portion 11, which are integrated together.

The main wall portion 11 is a wall portion that extends in the sheet conveyance direction and a width direction of the sheet conveyance path 3. The main wall portion 11 is provided with a light passing portion 11*a*.

The light passing portion 11*a* is a region to allow passage of the light from the reflection light source 30 and from the transmission light source 40. In this embodiment, the light passing portion 11*a* is a rectangular opening formed in the main wall portion 11. The light passing portion 11*a* may be a transparent window provided to the main wall portion 11. Alternatively, the entire conveyance guide 10 may be made of a transparent resin.

The inclined wall portion 12 extends from an upstream end of the main wall portion 11. The inclined wall portion 12 is inclined such that its upstream side gradually comes close to the sensor 20. The side wall portion 13 extends from an upstream end of the inclined wall portion 12 to the sensor 20.

The inclined wall portion 14 extends from a downstream end of the main wall portion 11. The inclined wall portion 14 is inclined such that its downstream side gradually comes close to the sensor 20. The side wall portion 15 extends from a downstream end of the inclined wall portion 14 to the sensor 20.

<Sensor>

The sensor 20 is a sensor that detects the amounts of light (the amount of reflected light and the amount of transmitted light) by receiving the light emitted from the reflection light source 30 and the transmission light source 40. The sensor 20 is disposed on the opposite side of the sheet conveyance path 3 at a region where the light passing portion 11*a* of the main wall portion 11 is formed. The sensor 20 executes detection of the light from the reflection light source 30 (the amount of reflected light) and detection of the light from the transmission light source 40 (the amount of transmitted light) in a time-shared manner. A result of detection of the amount of reflected light is used for identifying the paper type of the print sheet S while a result of detection of the amount of transmitted light is used for calculating the basis weight of the print sheet S.

<Reflection Light Source>

The reflection light source 30 is a light source that irradiates the print sheet S that is passed over the sheet conveyance path 3 with light. The reflection light source 30 is disposed on the opposite side of the sheet conveyance path 3 in such a way as to be juxtaposed to the sensor 20 in the width direction at the region where the light passing portion 11*a* of the main wall portion 11 is formed. Specifically, the reflection light source 30 and the sensor 20 are arranged in a direction orthogonal to a direction of an optical axis of the sensor 20 and to the sheet conveyance path 3. The light emitted from the reflection light source 30 is reflected from the print sheet S (or the reference sheet 70) on the sheet conveyance path 3 and is made incident on the sensor 20.

<Transmission Light Source>

The transmission light source 40 is a light source that irradiates the print sheet S that is passed over the sheet conveyance path 3 with light. The transmission light source 40 is disposed on the other side beyond the sheet conveyance path 3 at the region where the light passing portion 11*a* of the main wall portion 11 is formed, and is opposed to the sensor 20 in the direction of the optical axis of the sensor 20. The light emitted from the transmission light source 40 is transmitted through the print sheet S (or the reference sheet 70) on the sheet conveyance path 3 and is made incident on the sensor 20.

Specifically, the sensor 20 and other components are arranged in order of the sensor 20 (and the reflection light source 30), the conveyance guide (the light passing portion 11*a*), the sheet conveyance path 3 (the holder 60 and the reference sheet 70), and the transmission light source 40 in the direction orthogonal to the sheet conveyance path 3 and to the width direction.

<Driven Rollers>

The driven rollers 50 are guide members that guide the print sheet S being passed over the sheet conveyance path 3 from the upstream side to the downstream side. The driven rollers 50 are each formed into a columnar shape or a cylindrical shape so as to be rotatable around a rotating axis in the width direction, and are provided at positions to interpose the transmission light source 40 in between in the width direction. The driven rollers 50 function as controllers that control a movement of the holder 60 in a direction to move away from the sensor 20.

<Holder>

Figure 4A:
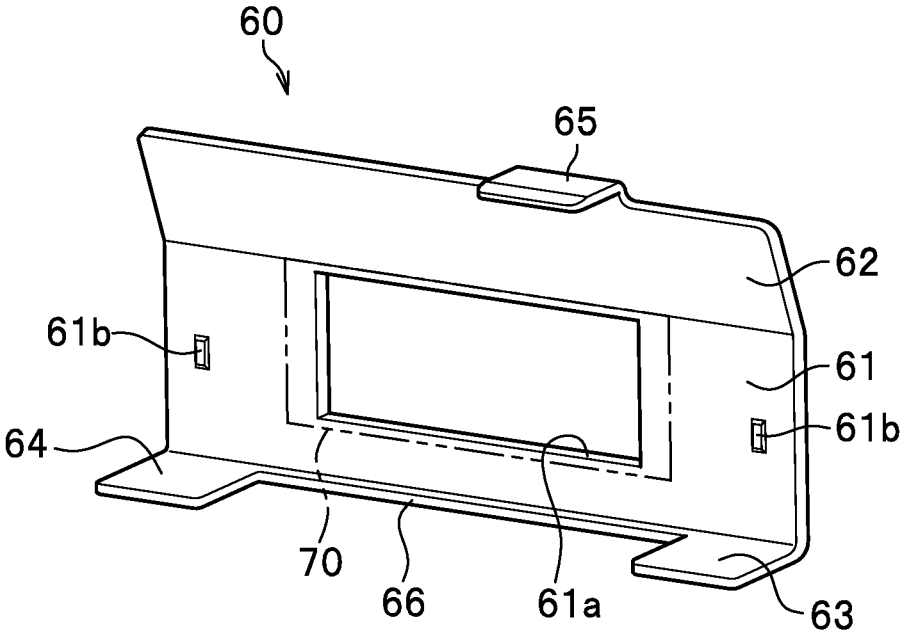
FIG. 4A is a perspective view schematically showing a holder and a reference paper sheet and FIG. 4B is an enlarged diagram showing grooves formed in an attachment.
Figure 4B:
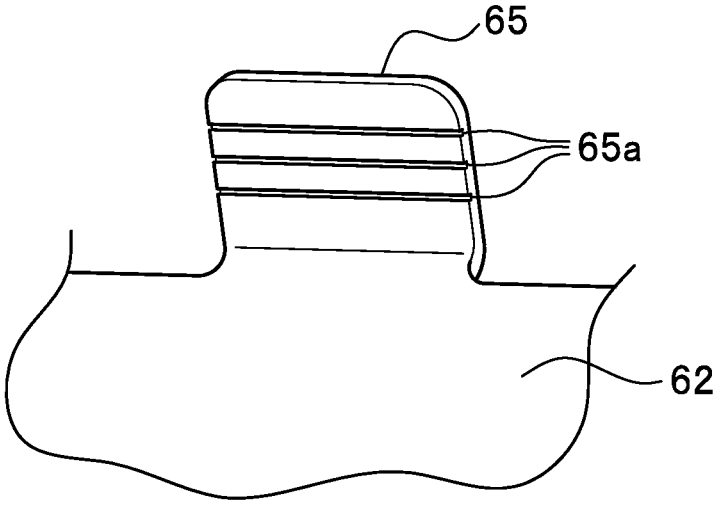
Figure 5:
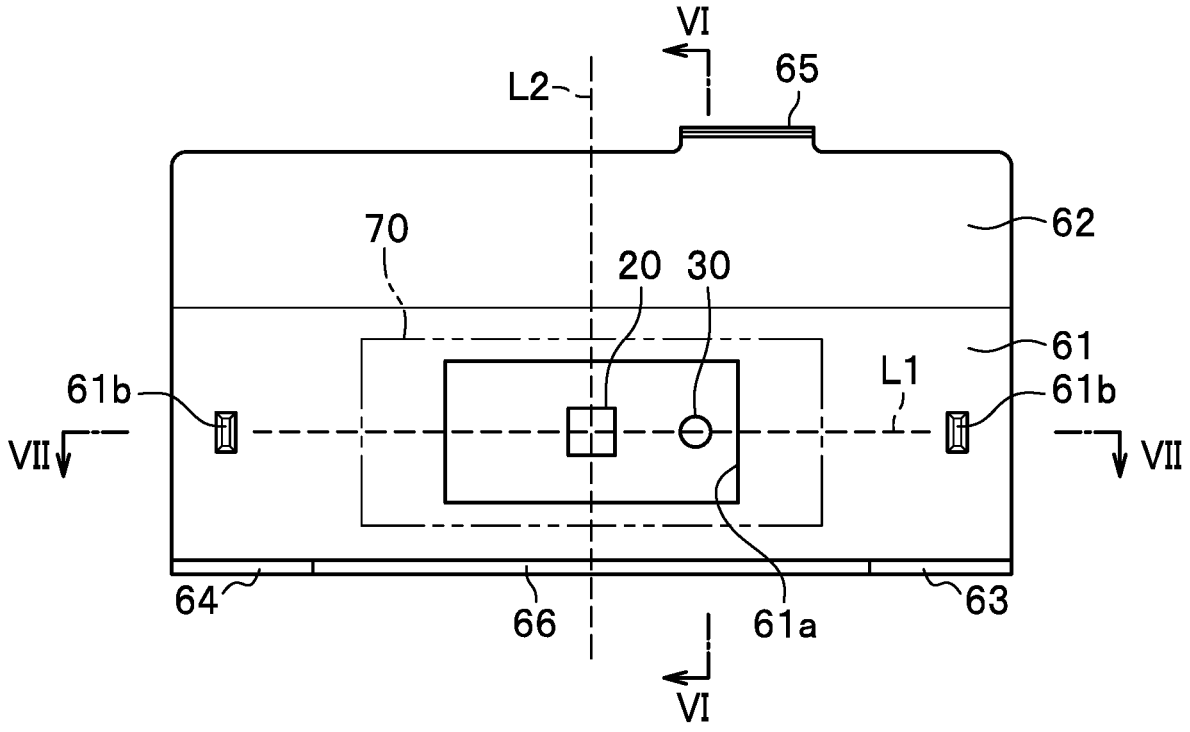
FIG. 5 is a schematic diagram of the holder viewed from a sensor side.

The holder 60 is a resin member which is attachably and detachably provided between the sensor 20 and the transmission light source 40 while holding the reference sheet 70. As shown in FIGS. 4A to 5, the holder 60 includes a main wall portion 61, an inclined wall portion 62, attachments 63, 64, and 65, and a rib 66, which are integrated together.

The main wall portion 61 is a region opposed to the main wall portion 11 and the inclined wall portion 12 of the conveyance guide 10. The main wall portion 61 includes a light passing portion 61*a* and abutting portions 61*b*.

The light passing portion 61*a* is a region that allows passage of the light from the transmission light source 40. In this embodiment, the light passing portion 61*a* is a rectangular opening formed in the main wall portion 61. The light passing portion 61*a* may be a transparent window provided to the main wall portion 61. Alternatively, the entire holder 60 may be made of a transparent resin.

The abutting portions 61*b* are protrusions that project from the main wall portion 61 to the sensor 20 side. The abutting portions 61*b* are provided at such positions that interpose the light passing portion 61*a* in the width direction, and tip ends of the abutting portions 61*b* abut on the main wall portion 11. The abutting portions 61*b* function as positioning portions that position the holder 60 relative to the sensor 20 in the direction of the optical axis of the sensor 20 (so as to control the movement of in a direction to come close to the sensor 20). The abutting portions 61*b* are arranged in a direction orthogonal to the direction of the optical axis of the sensor 20 and to the sheet conveyance direction, and are provided at positions to overlap the corresponding driven rollers 50, respectively, when viewed along an axis in the direction of the optical axis of the sensor 20.

The inclined wall portion 62 is a region provided opposite to the inclined wall portion 14 of the conveyance guide 10, and extends from a downstream end of the main wall portion 61. The inclined wall portion 62 is inclined such that its downstream side gradually comes close to the sensor 20.

The attachments 63 and 64 extend from an upstream end of the main wall portion 61 to the sensor 20. The attachment 63 is a projecting piece that extends from one end in the width direction of the main wall portion 61, and is an elastically deformable portion that is elastically deformable in the sheet conveyance direction (the upstream direction and the downstream direction). The attachment 64 is a projecting piece that extends from the other end in the width direction of the main wall portion 61, and is an elastically deformable portion that is elastically deformable in the sheet conveyance direction (the upstream direction and the downstream direction).

The attachment 65 extends from a downstream end of the inclined wall portion 62 to the sensor 20. The attachment 65 is a projecting piece that extends from an intermediate portion in the width direction of the inclined wall portion 62, and is an elastically deformable portion that is elastically deformable in the sheet conveyance direction (the upstream direction and the downstream direction). Multiple grooves 65*a* extending parallel to the main wall portion 61 are formed in an upstream side surface of the attachment 65.

The two attachments 63 and 64 as well as the one attachment 65 clamp the conveyance guide 10 serving as the attachment target part of the image formation apparatus 1 in the sheet conveyance direction by using resilience associated with elastic deformation.

The rib 66 extends in such a way as to connect base ends of the attachments 63 and 64 to each other at the upstream end of the main wall portion 61. The rib 66 is designed to increase rigidity of a portion between the attachments 63 and 64.

<Reference Sheet>

The reference sheet 70 is a sheet having a given thickness, which is provided in such a way as to block the light passing portion 61*a* of the main wall portion 61 from the sensor 20 side. The reference sheet 70 is held by a surface on the sensor 20 side of the main wall portion 61 by using a double-sided tape or the like. The reference sheet 70 is provided at a position opposed to the sensor 20 while being held by the holder 60.

<Method of Obtaining Calibration Data by Using Holder>

The holder 60 holding the reference sheet 70 is attached to the conveyance guide 10 by causing the attachments 63 and 64 as well as the attachment 65 to clamp the conveyance guide 10 in a state where a door of the image formation apparatus 1 is open. Here, the attachments 63 and 64 are pressed against the side wall portion 13 from the upstream side by the resilience associated with elastic deformation while the attachment 65 is pressed against the side wall portion 15 from the downstream side by the resilience associated with elastic deformation. Meanwhile, the abutting portions 61*b* abut on the main wall portion 11 of the conveyance guide 10, thereby positioning the reference sheet 70 in the direction of the optical axis of the sensor 20. The abutting portions 61*b* are pressed against the main wall portion 11 by frictional forces among the attachments 63 to 65 and the side wall portions 13 and 15. In the meantime, the driven rollers 50 abut on a surface on the transmission light source 40 side of the main wall portion 11 and control the movement of the holder 60 to the transmission light source 40 side. The driven rollers 50 abut on side surfaces on the transmission light source 40 side of the main wall portion 11 by closing the door of the image formation apparatus 1.

In this state, the sensor 20 detects the amount of light (the amount of reflected light) emitted from the reflection light source 30 and reflected from the reference sheet 70. Moreover, the sensor 20 detects the amount of light (the amount of transmitted light) emitted from the transmission light source 40 and transmitted through the reference sheet 70. The amount of reflected light and the amount of transmitted light involving the reference sheet 70, which are detected by the sensor 20, are outputted to the control unit 120 (see FIG. 1) and used as calibration data. For example, the control unit 120 calibrates the amount of light (the result of detection by the sensor 20) emitted from the reflection light source 30 and reflected from the print sheet S based on the amount of light reflected from the reference sheet 70 and on distances from the sensor 20 and the reflection light source 30 to the reference sheet 70 stored in advance. In the meantime, the control unit 120 calibrates the amount of light (the result of detection by the sensor 20) emitted from the transmission light source 40 and transmitted through the print sheet S based on the amount of light reflected from the reference sheet 70, on distances from the sensor 20 and the transmission light source 40 to the reference sheet 70 stored in advance, and on a thickness of the reference sheet 70. Thus, the control unit 120 can execute identification of the paper type of the print sheet S and calculation of the basis weight thereof at high accuracy.

<Holding Position of Reference Sheet>

Figure 6A:
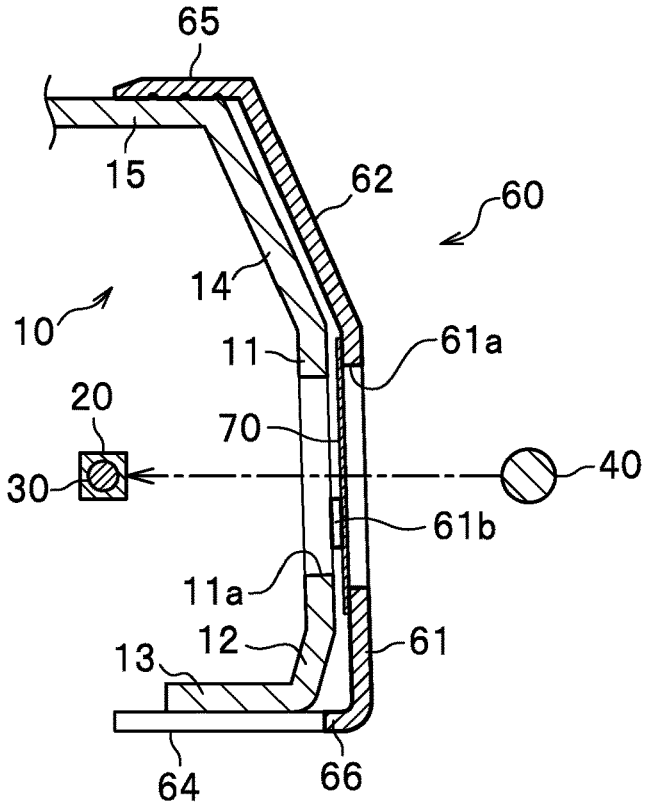
Figure 7A:
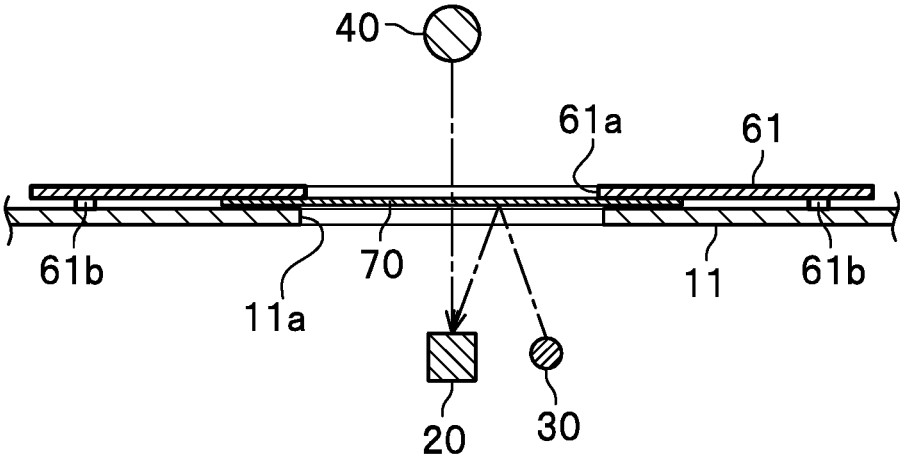

As shown in FIGS. 6A and 7A, the reference sheet 70 is located on the sensor 20 side of the light passing portion 61*a* due to the following reason. Specifically, if the reference sheet 70 is located on the transmission light source 40 side of the light passing portion 61*a*, the light from the reflection light source 30 may develop vignetting at an inner peripheral portion of the light passing portion 61*a*.

<Method of Disposing Positioning Portions>

Figure 8A:
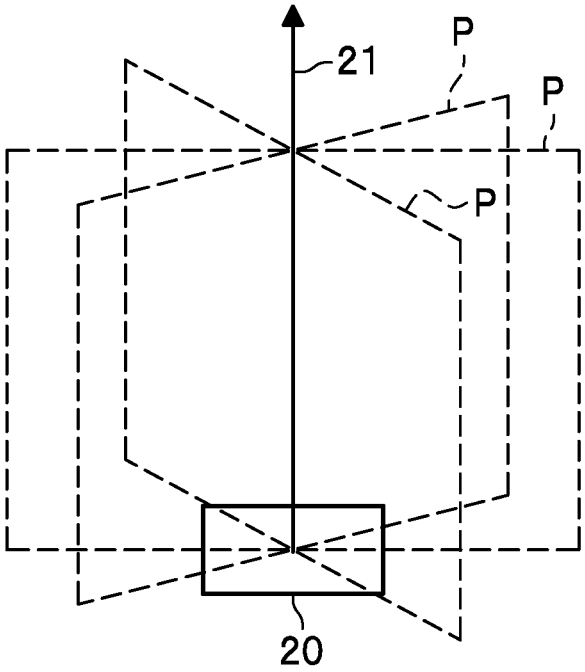
FIG. 8A is a schematic diagram for explaining a plane including an optical axis of the sensor and FIG. 8B is a schematic diagram showing a state where abutting portions are projected on a certain plane.
Figure 8B:
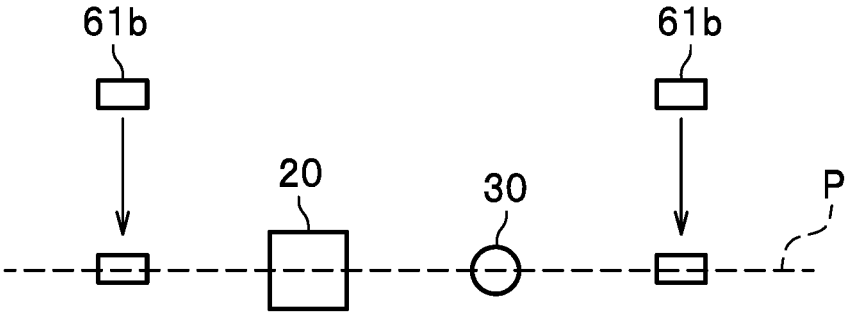

As shown in FIG. 8A, a plane P that includes an optical axis 21 of the sensor 20 is present around the optical axis 21. Here, when the abutting portions 61*b* are projected on a certain plane P as shown in FIG. 8B, projections of the abutting portions 61*b* are located across the sensor 20. As described above, even when the abutting portions 61*b* are located as the positions offset from the plane P including the optical axis 21, the abutting portions 61*b* can stabilize postures of the holder 60 and the reference sheet 70 as long as the projections of the abutting portions 61*b* are located across the sensor 20. Meanwhile, when the abutting portions 61*b* are projected on the certain plane P, the projections of the abutting portions 61*b* are located across the sensor 20 and the reflection light source 30. In this embodiment, as shown in FIG. 5, the abutting portions 61*b*, the sensor 20, and the reflection light source 30 are arranged on a straight line when viewed in the direction of the optical axis 21 of the sensor 20.

<Postural Maintenance of Holder by Groove>

Figure 6B:
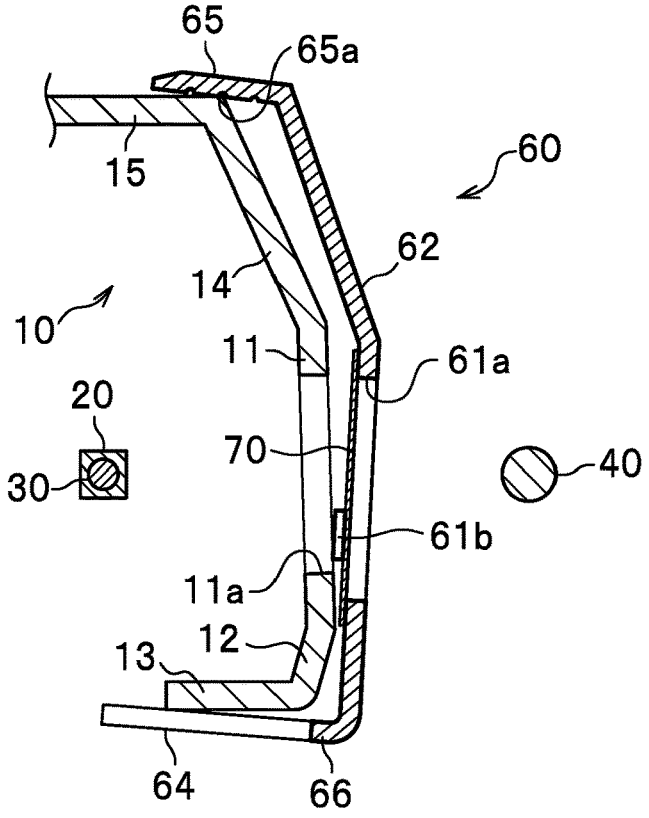
Figure 7B:
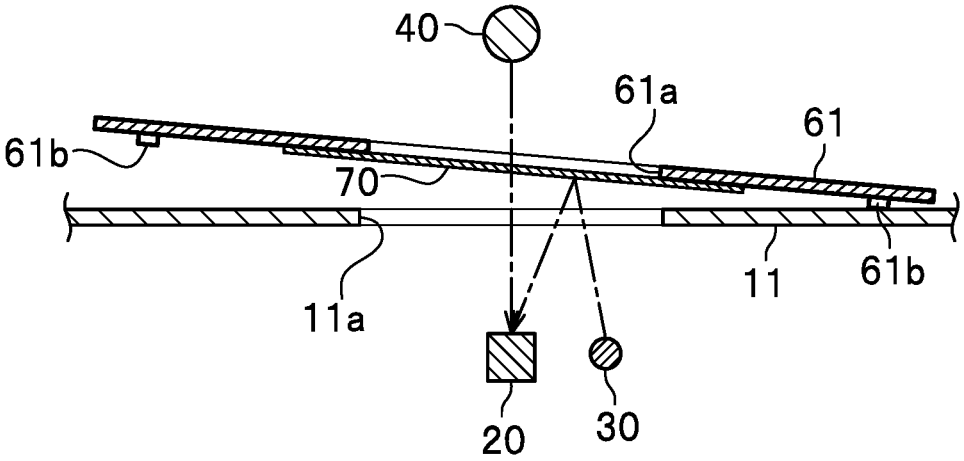

In case the holder 60 is about to come off the conveyance guide 10 as shown in FIG. 6B, one of the grooves 65*a* in the attachment 65 engages with a corner portion located between the inclined wall portion 14 and the side wall portion 15. Thus, the state of the abutting portions 61*b* abutting on the main wall portion 11 is maintained. Accordingly, the holder 60 and the reference sheet 70 are rotated around an axis in the direction of arrangement of the sensor 20 and the reflection light source 30. Meanwhile, the holder 60 and the reference sheet 70 are kept from being rotated around an axis in a direction orthogonal to the direction of arrangement of the sensor 20 and the reflection light source 30 (that is, in the sheet conveyance direction) as shown in FIG. 7B. Here, rotation of the holder 60 and the reference sheet 70 as shown in FIG. 7B may lead to a change in distance of the light from the reflection light source 30 that is reflected from the reference sheet 70 and made incident on the sensor 20 among other things. This may cause an adverse effect on the calibration data based on the light from the reflection light source 30. On the other hand, when the groove 65*a* of the attachment 65 engages with the corner portion between the inclined wall portion 14 and the side wall portion 15 as shown in FIG. 6B, this configuration suppresses the adverse effect on the distance of the light from the reflection light source 30 that is reflected from the reference sheet 70 and made incident on the sensor 20 among other things. As a consequence, the calibration data based on the light from the reflection light source 30 are appropriately detected.

<Positional Relations Among Attachments>

As shown in FIG. 5, the attachment 63 and the attachment 64 are provided on the upstream end of the holder 60 and are arranged parallel to a direction of a line L1 that connects the sensor 20 and the reflection light source 30. The attachment 63 is located on the reflection light source 30 side relative to the sensor 20 in the direction of the line L1 that connects the sensor 20 and the reflection light source 30 (on the reflection light source 30 side relative to a line L2 that is orthogonal to the optical axis of the sensor 20 and to the line L1). The attachment 64 is located on the opposite side to the reflection light source 30 relative to the sensor 20 in the direction of the line L1 that connects the sensor 20 and the reflection light source 30 (on the opposite side of the reflection light source 30 relative to the line L2). The attachment 63 and the attachment 64 are located on outer sides of the sensor 20 and the reflection light source 30 in the width direction of the sheet conveyance path 3 in such a way as to sandwich the sensor 20 and the reflection light source 30. Specifically, assuming that the sensor 20 is an intermediate portion in the width direction, the attachment 63 is located on the outer side in the width direction of the reflection light source 30 while the attachment 64 is located on the outer side in the width direction of the sensor 20. The attachments 63 and 64 control rotation of the reference sheet 70 around the line L2 (around an axis in a direction orthogonal to the optical axis of the sensor 20 and to the line L1). The attachment 65 is provided on the downstream end of the holder 60 and is located on the reflection light source 30 side relative to the sensor 20 in the direction of the line L1 that connects the sensor 20 and the reflection light source 30 (on the reflection light source 30 side relative to the line L2). The sensor 20, the reflection light source 30, and the transmission light source 40 are disposed inside a triangle that is defined by the attachments 63, 64, and 65 in view of an axis in the direction of the optical axis of the sensor 20.

<Method of Disposing Holder>

Figure 9:
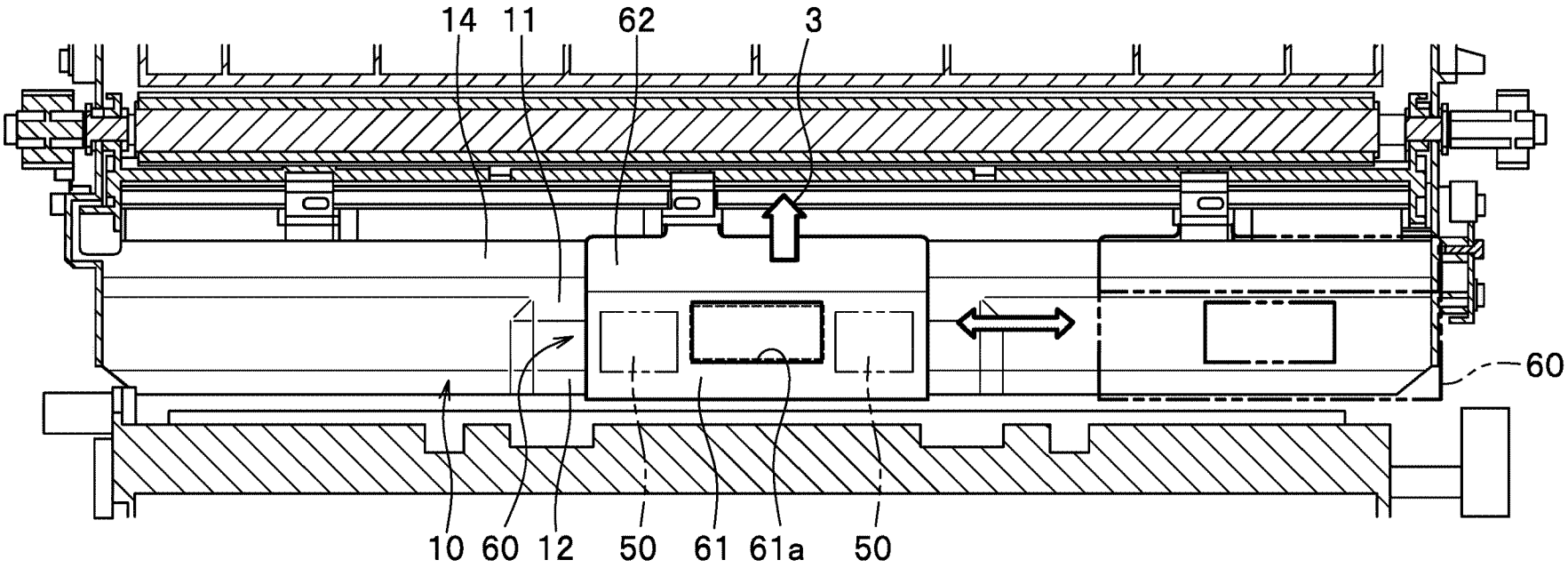
FIG. 9 is a schematic diagram for explaining a movement of the holder relative to the conveyance guide.

The holder 60 may be provided attachably to and detachably from any of the conveyance guide 10, the sensor 20, and the reflection light source 30, and may be movably provided between a point above the sheet conveyance path 3 and any of retracting positions (see chain double-dashed lines in FIG. 9) along the conveyance guide 10 as shown in FIG. 9. The holder 60 is located above the sheet conveyance path 3 during the calibration and located at the retracting position during image formation on the print sheet S. Note that this movement may be manually conducted or automatically conducted by control of a motor or the like through the control unit 120.

The holder 60 according to the embodiment of the present invention is the holder 60 configured to hold the reference sheet 70 in order to calibrate the sensor 20 configured to optically measure a characteristic of a sheet on the sheet conveyance path 3 in the image formation apparatus 1, which includes the two attachments 63 and 64 (or 65 and 64) to be attached to the attachment target part of the image formation apparatus 1. One of the attachments 63 (or 65) is located on the reflection light source 30 side relative to the sensor 20 in the direction of the line connecting the sensor 20 and the reflection light source 30 of the image formation apparatus 1, and the other attachment 64 is located on the opposite side to the reflection light source 30 relative to the sensor 20 in the direction of the line. Thus, the holder 60 can maintain the constant distance between the reference sheet 70 and the sensor 20, or to be more precise, the constant distance from the reflection light source 30 to the sensor 20 via the reference sheet 70 by preventing the reference sheet 70 from being rotated around the axis in the sheet conveyance direction (the line L2), thereby enabling appropriate detection of the calibration data.

The two attachments 65 and 64 are the elastically deformable portions. The two attachments 65 and 64 may be provided in such a way as to clamp the attachment target part in the direction orthogonal to the direction of the line by using the resilience associated with elastic deformation. Thus, the holder 60 is attached to the attachment target part without using external members such as screws, and can therefore secure the sheet conveyance path 3 appropriately without adversely affecting the shape of the attachment target part (such as the conveyance guide 10).

At least one of the two attachments 63 and 64 (or 65 and 64) may be provided with the groove 65*a* engageable with the attachment target part in such a way as to be parallel to the line connecting the sensor 20 and the reflection light source 30. Thus, even when the holder 60 is about to come off the attachment target part, the groove 65*a* engages with the attachment target part, and can therefore reduce a posture error due to the rotation of the reference sheet 70 around the axis in the sheet conveyance direction.

In the meantime, the holder 60 is the holder 60 configured to hold the reference sheet 70 in order to calibrate the sensor 20 configured to optically measure a characteristic of a sheet on the sheet conveyance path 3 in the image formation apparatus 1, which includes the three attachments 63, 64, and 65 to be attached to the attachment target part of the image formation apparatus 1. The three attachments 63, 64, and 65 are the elastically deformable portions. The two attachments 63 and 64 of the three attachments 63, 64, and 65 are provided on the one end side of the holder 60 and the one attachment 65 thereof is provided on the other end side of the holder 60. The three attachments 63, 64, and 65 are provided in such a way as to clamp the attachment target part by using the resilience associated with elastic deformation. Thus, the holder 60 can maintain the constant distance between the reference sheet 70 and the sensor 20 by more appropriately preventing the reference sheet 70 from being rotated around the axis in the width direction, of the reference sheet 70, thereby enabling appropriate detection of the calibration data. Moreover, the holder 60 is attached to the attachment target part without using external members such as screws, and can therefore secure the sheet conveyance path 3 appropriately without adversely affecting the shape of the attachment target part (such as the conveyance guide 10).

The two attachments 63 and 64 provided on the one end side of the holder 60 are arranged parallel to the direction of arrangement of the sensor 20 and the reflection light source 30, and the rib 66 configured to connect the two attachments 63 and 64 to each other may be formed on the one end side of the holder 60. Thus, the holder 60 can prevent the rotation of the reference sheet 70 around the axis in the width direction more appropriately by improving rigidity of the base ends of the attachments 63 and 64.

The two attachments 63 and 64 provided on the one end side of the holder 60 may be located on the outer sides of the sensor 20 and the reflection light source 30 in the width direction of the sheet conveyance path 3 in such a way as to sandwich the sensor 20 and the reflection light source 30. Thus, a large interval is secured between the elastically deformable portions 63 and 64 so that the holder 60 can prevent the rotation of the reference sheet 70 around the axis in the width direction more appropriately.

The one attachment 65 provided on the other end side of the holder 60 may be provided on the reflection light source 30 side relative to the sensor 20 in the direction of the line connecting the sensor 20 and the reflection light source 30 of the image formation apparatus 1. Thus, the holder 60 can reduce a change in amount of reflected light due to the rotation around the axis in the width direction.

One of the two attachments 63 and 64 provided on the one end side of the holder 60 may be located on the reflection light source 30 side relative to the sensor 20 in the direction of the line, and the other one of the two attachments 63 and 64 provided on the one end side of the holder 60 may be located on the opposite side to the reflection light source 30 relative to the sensor 20 in the direction of the line. Thus, the holder 60 can maintain the constant distance between the reference sheet 70 and the sensor 20 by preventing the reference sheet 70 from being rotated around the axis in the width direction of the reference sheet 70, thereby enabling appropriate detection of the calibration data.

The two attachments and the one attachment may be provided in such a way as to clamp the attachment target part in the direction orthogonal to the direction of the line by using the resilience associated with elastic deformation. Thus, the holder 60 is attached to the attachment target part without using external members such as screws, and can therefore secure the sheet conveyance path 3 appropriately without adversely affecting the shape of the attachment target part (such as the conveyance guide 10).

At least one of the three attachments 63, 64, and 65 may be provided with the groove 65*a* engageable with the attachment target part in such a way as to be parallel to the line connecting the sensor 20 and the reflection light source 30. Thus, even when the holder 60 is about to come off the attachment target part, the groove 65*a* engages with the attachment target part, thereby reducing a posture error due to the rotation of the reference sheet 70 around the axis in the width direction.

The groove 65*a* may be formed in the one attachment 65 provided on the other end side of the holder 60. Thus, the groove 65*a* is provided in the one attachment 65 that is rotated relatively easily, so that the holder 60 can reduce the posture error due to the rotation of the reference sheet 70 around the axis in the width direction.

Although embodiments of the present invention have been described and illustrated in detail, the disclosed embodiments are made for purposes of illustration and example only and not limitation. The scope of the present invention should be interpreted by terms of the appended claims. For example, the holder 60 may be configured to abut on or to be attached to the sensor 20 or the reflection light source 30 instead of the conveyance guide 10. Meanwhile, the reference sheet 70 only needs to be disposed between the sensor 20 and the transmission light source 40 while being held by the holder 60. In this context, the reference sheet 70 may be disposed at a position offset from the sheet conveyance path 3 to the sensor 20 side or the transmission light source 40 side.

What is claimed is:

1. A holder configured to hold a reference sheet in order to calibrate a sensor configured to optically measure a characteristic of a sheet on a sheet conveyance path in an image formation apparatus, comprising:

first and second attachments to be attached to an attachment target part of the image formation apparatus, wherein the first attachment is located on a reflection light source side relative to the sensor in a direction of a line connecting the sensor and a reflection light source of the image formation apparatus, and the second attachment is located on an opposite side to the reflection light source relative to the sensor in the direction of the line.

2. The holder according to claim 1, wherein the first and second attachments are elastically deformable portions, and the first and second attachments are provided in such a way as to clamp the attachment target part in a direction orthogonal to the direction of the line by using resilience associated with elastic deformation.

3. The holder according to claim 2, wherein at least one of the first and second attachments is provided with a groove engageable with the attachment target part in such a way as to be parallel to the line connecting the sensor and the reflection light source.

4. A holder configured to hold a reference sheet in order to calibrate a sensor configured to optically measure a characteristic of a sheet on a sheet conveyance path in an image formation apparatus, comprising:

first, second, and third attachments to be attached to an attachment target part of the image formation apparatus, wherein the first, second, and third attachments are elastically deformable portions, the first and second attachments are provided on one end side of the holder and the third attachment is provided on other end side of the holder, and the first, second, and third attachments are provided in such a way as to clamp the attachment target part by using resilience associated with elastic deformation.

5. The holder according to claim 4, wherein the first and second attachments provided on the one end side of the holder are arranged parallel to a direction of arrangement of the sensor and a reflection light source, and a rib connecting the first and second attachments is formed on the one end side of the holder.

6. The holder according to claim 4, wherein the first and second attachments provided on the one end side of the holder are located outwardly from the sensor and a reflection light source in a width direction of the sheet conveyance path in such a way as to sandwich the sensor and the reflection light source.

7. The holder according to claim 4, wherein the third attachment provided on the other end side of the holder is provided on a reflection light source side relative to the sensor in a direction of a line connecting the sensor and the reflection light source of the image formation apparatus.

8. The holder according to claim 7, wherein one of the first and second attachments provided on the one end side of the holder is located on the reflection light source side relative to the sensor in the direction of the line, and the other one of the first and second attachments provided on the one end side of the holder is located on the opposite side to the reflection light source relative to the sensor in the direction of the line.

9. The holder according to claim 8, wherein the first, second, and third attachments are provided in such a way as to clamp the attachment target part in a direction orthogonal to the direction of the line by using resilience associated with elastic deformation.

10. The holder according to claim 4, wherein at least one of the first, second, and third attachments is provided with a groove engageable with the attachment target part in such a way as to be parallel to a line connecting the sensor and a reflection light source.

11. The holder according to claim 10, wherein the groove is formed in the third attachment provided on the other end side of the holder.

* * * * *